US008879962B2

(12) United States Patent
Sato

(10) Patent No.: US 8,879,962 B2
(45) Date of Patent: Nov. 4, 2014

(54) DEVELOPING UNIT

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 379 days.

(21) Appl. No.: 12/913,595

(22) Filed: Oct. 27, 2010

(65) Prior Publication Data

US 2011/0103843 A1 May 5, 2011

(30) Foreign Application Priority Data

Oct. 29, 2009 (JP) ..... 2009-248674

(51) Int. Cl.
*G03G 15/08* (2006.01)

(52) U.S. Cl.
CPC .... *G03G 15/0812* (2013.01); *G03G 2215/0838* (2013.01); *G03G 15/0822* (2013.01)
USPC ..... 399/254; 399/260; 399/263

(58) Field of Classification Search
USPC ..... 399/254, 260, 263
See application file for complete search history.

(56) References Cited

U.S. PATENT DOCUMENTS

| | | | | |
|---|---|---|---|---|
| 5,465,139 | A | 11/1995 | Kimura et al. | |
| 5,655,193 | A | 8/1997 | Fujishiro et al. | |
| 2002/0071697 | A1 | 6/2002 | Fujimoto | |
| 2007/0071503 | A1* | 3/2007 | Sato | 399/258 |
| 2007/0189811 | A1 | 8/2007 | Sato | |
| 2007/0223971 | A1 | 9/2007 | Takagi | |
| 2008/0213008 | A1 | 9/2008 | Sato | |
| 2009/0169245 | A1 | 7/2009 | Sato | |
| 2010/0202803 | A1 | 8/2010 | Sato et al. | |
| 2010/0272474 | A1 | 10/2010 | Sato | |

FOREIGN PATENT DOCUMENTS

| | | | |
|---|---|---|---|
| CN | 101833272 | A | 9/2010 |
| EP | 1818730 | A2 | 8/2007 |
| JP | H05-313488 | A | 11/1993 |
| JP | H06-301290 | A | 10/1994 |
| JP | H08-146765 | A | 6/1996 |
| JP | 2001-066857 | A | 3/2001 |

(Continued)

OTHER PUBLICATIONS

State Intellectual Property Office of the People'S Republic of China, The Second Office Action for Chinese Patent Application No. 201010538400.X (counterpart Chinese patent application), mailed Dec. 21, 2012.

(Continued)

*Primary Examiner* — David Gray
*Assistant Examiner* — Andrew Do
(74) *Attorney, Agent, or Firm* — Baker Botts L.L.P.

(57) ABSTRACT

A developing unit comprises a developing portion, a first developer storage portion and a partitioning wall. The developing portion includes a rotatable developer carrier, a rotatable supply member configured to supply the developer to the developer carrier, a regulating member contacting with the developer carrier to regulate the thickness of the developer on the developer carrier, and a developer feeding member arranged below the regulating member and configured to feed the developer. The partitioning wall is configured to partition between the developing portion and the first developer storage portion. The partitioning wall has a supply port for supplying the developer from the first developer storage portion to the developing portion. The regulating member is contacting with the developer carrier at a contact position located above an upper level of the developer in the developing portion.

8 Claims, 8 Drawing Sheets

(56) References Cited

FOREIGN PATENT DOCUMENTS

| | | | |
|---|---|---|---|
| JP | 2002-040773 | A | 2/2002 |
| JP | 2002-182474 | A | 6/2002 |
| JP | 2006-301504 | A | 11/2006 |
| JP | 2007-293268 | A | 11/2007 |
| JP | 2008-129344 | A | 6/2008 |
| JP | 2009-009119 | A | 1/2009 |

OTHER PUBLICATIONS

State Intellectual Property Office of the People'S Republic of China, The First Office Action for Chinese Patent Application No. 201010538400.X (counterpart to above-captioned patent application), mailed Mar. 31, 2012.

State Intellectual Property Office of the People's Republic of China, The Decision of Rejection for Chinese Patent Application No. 201010538400.X (counterpart Chinese patent application), mailed Jun. 25, 2013.

Japan Patent Office, Notice of Reasons for Rejection for Japanese Patent Application No. 2009-248674 (counterpart Japanese patent application), mailed Jun. 18, 2013.

European Patent Office, Office Action for European Application No. 10014089.6-1559, mailed Dec. 12, 2013.

European Patent Office, Search Report for European Application No. 10014089.6-1559, mailed Oct. 2, 2011.

* cited by examiner

DEVELOPING UNIT

CROSS REFERENCE TO RELATED APPLICATION

The present application claims priority from Japanese Patent Application No. 2009-248674, filed on Oct. 29, 2009, the disclosure of which is incorporated herein by reference in its entirely.

BACKGROUND

1. Technical Field

The present invention relates to a developing unit configured to supply developer to an electrostatic latent image formed on a photoconductive member.

2. Related Art

In the related art, a developing unit including a developing portion having a developing roller that carries developer, and a developer storage portion configured to accommodate the developer and arranged adjacent to the developing portion is known. More specifically, the developing portion in this technology includes a supply roller configured to supply the developer to the developing roller and a regulating member configured to regulate the thickness of the developer carried on the developing roller by coming into sliding contact with the developing roller.

A partitioning wall configured to partition between the developing portion and the developer storage portion is formed with a supply port for supplying the developer from the developer storage portion to the developing portion. Then, the supply port is formed in such a manner that an upper end thereof is positioned above a contact position where the regulating member contacts the developing roller when the developing unit is mounted on the image forming apparatus.

SUMMARY

However, if the supply port is formed as in the related art, there is a case where an upper level of the developer in the developing portion may be positioned above the contact position. In such a case, developer scraped off by the regulating member or abnormal substances such as paper powder may be accumulated and trapped in the vicinity of the contact position. If the abnormal substances stay being accumulated in the vicinity of the contact position as described above, the substances may pass through a gap between the regulating member and the developing roller and may cause problems of printing failure and toner leakage.

A need has arisen to provide a developing unit which may reduce such substances from passing through a gap between a regulating member and a developing roller (an example of a developer carrier).

According to an embodiment of the present invention, a developing unit comprises a developing portion, a first developer storage portion and a partitioning wall. The developing portion includes a rotatable developer carrier configured to carry developer. The developing portion further includes a rotatable supply member arranged below the developer carrier and configured to supply the developer to the rotatable developer carrier. The developing portion still further includes a regulating member configured to come into sliding contact with the developer carrier to regulate the thickness of the developer on the rotatable developer carrier. Moreover, the developing portion includes a developer feeding member arranged below the regulating member and configured to feed the developer in a direction of a rotation axis of the rotatable supply member. The first developer storage portion is configured to accommodate the developer and arranged adjacent to the developing portion. The partitioning wall is configured to partition between the developing portion and the first developer storage portion. The partitioning wall has a supply port for supplying the developer from the first developer storage portion to the developing portion, and further has a return port for returning the developer from the developing portion to the first developer storage portion. The regulating member is contacting with the rotatable developer carrier at a contact position located above an upper level of the developer in the developing portion.

According to the present invention, the foreign substances scraped off by the regulating member are restrained from being accumulated in the vicinity of the contact position and therefore the foreign substances can be restrained from passing through a gap between the regulating member and the developer carrier.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein.

DESCRIPTION OF PREFERRED EMBODIMENTS

Embodiments of the invention and their features and advantages may be understood by referring to FIGS. 1-8, like numerals being used for like corresponding parts in the various drawings. In the description given below, an entire configuration of a developing unit in brief first, and then characteristic portions of the invention will be described in detail.

In the following description, the directions are expressed with reference to a user using a laser printer. In other words, in FIG. 1, the observer's right side is expressed as "front side (near side)", the observer's left side is expressed as "rear side (back side)", the side far from the observer is expressed as "right side", and the near side to the observer is expressed as "left side". The vertical direction for the observer is expressed as "vertical direction".

<General Configuration of Laser Printer>

Figure 1:
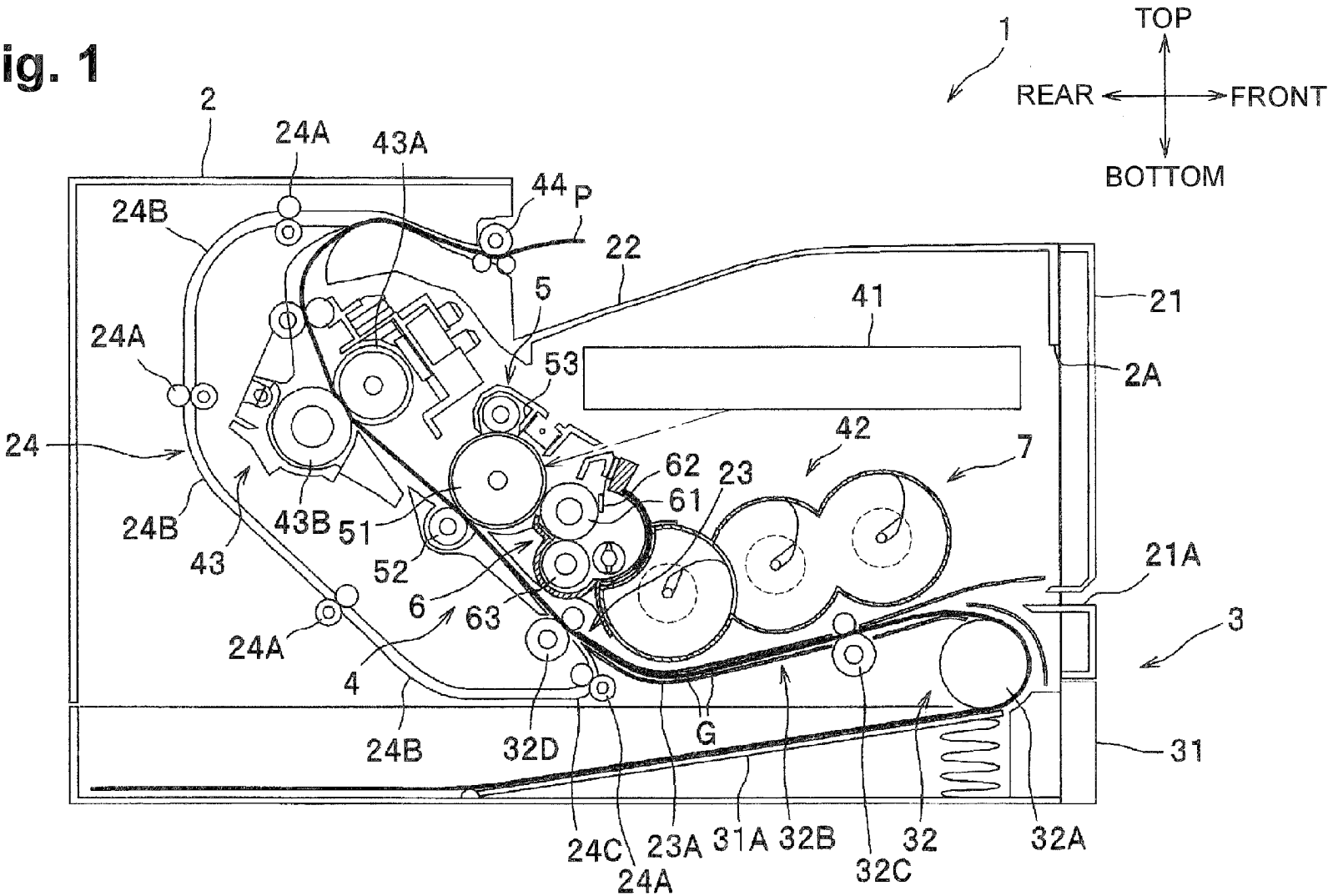
FIG. 1 is a cross-sectional view of a laser printer having a developing unit according to an embodiment of the present invention.

As shown in FIG. 1, a laser printer 1 includes an apparatus body 2, a feeder unit 3, and an image forming unit 4.

Figure 2:
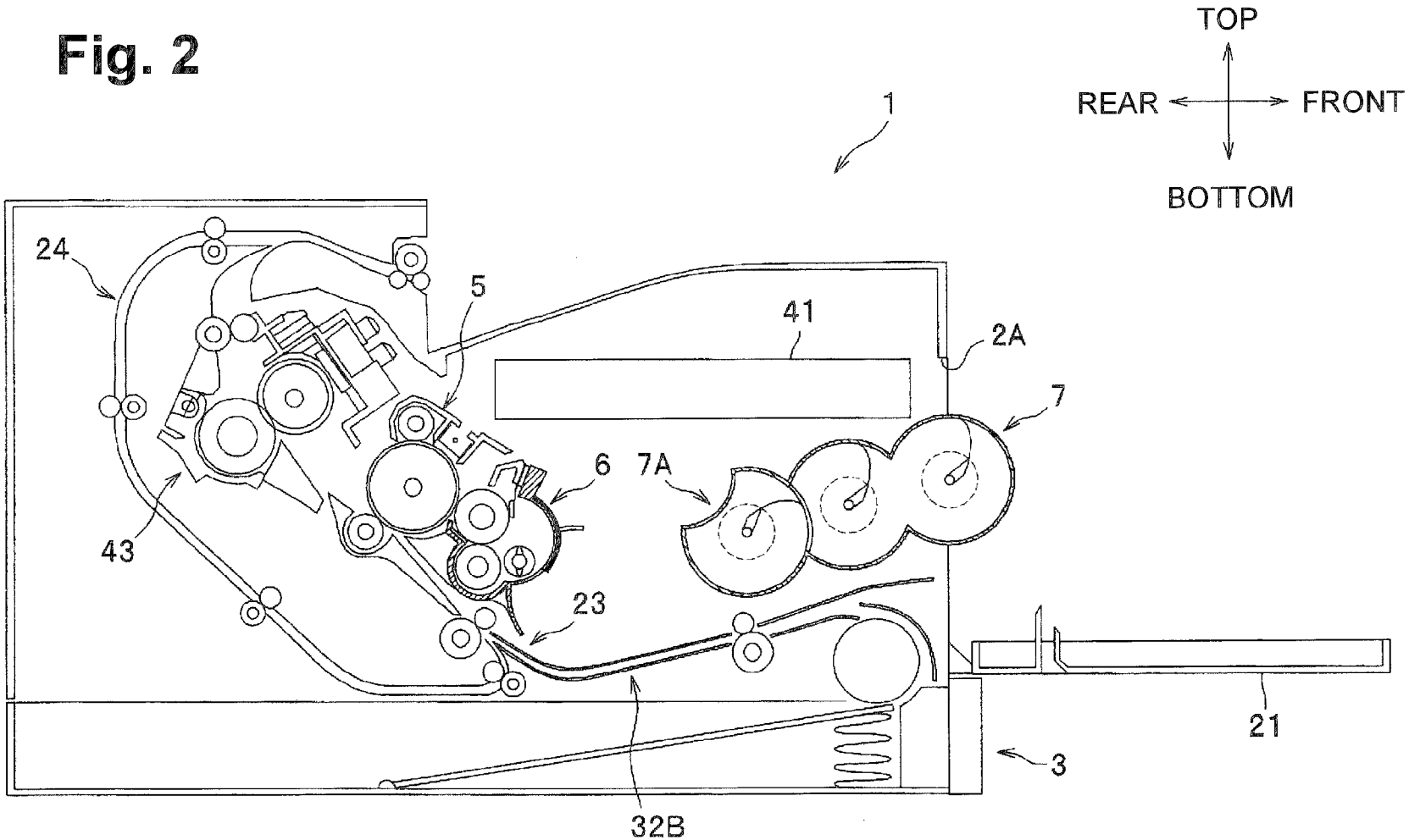
FIG. 2 is a cross-sectional view showing a state in which a front cover is opened to take out a toner cartridge.

The apparatus body 2 is formed into a hollow case shape. The front wall thereof is formed with an opening 2A, and, as shown in FIG. 2, a front cover 21 for opening and closing the opening 2A is provided. The front cover 21 is formed with a manual paper feed port 21A so as to face a first transport path 32B, described later. An upper surface of the apparatus body 2 includes a paper discharge tray 22 on which printed papers P are placed.

The feeder unit 3 includes a paper feed tray 31 and a paper feed mechanism 32.

The paper feed tray 31 is a tray for placing the papers P on top of another, and is arranged below the image forming unit 4 (in the lower portion of the apparatus body 2). Provided in the paper feed tray 31 is a pressing plate 31A for pressing a leading edge of the paper P toward a paper feed roller 32A, described later.

The paper feed mechanism 32 is arranged above the front side of the paper feed tray 31, and mainly includes the paper feed roller 32A, the first transport path 32B, transport rollers 32C, and registration rollers 32D.

The paper feed roller 32A is a roller configured to transport the paper P placed in the paper feed tray 31 toward the image forming unit 4 by folding back it into a U-shape, and is formed to have a relatively large diameter for favorably folding back the paper P.

The first transport path 32B is made up of a plurality of guides G, and is formed to incline from above the paper feed roller 32A backward and obliquely downward. Formed continuously from a rear end of the first transport path 32B is a second transport path 23.

The second transport path 23 is made up of the guides G and a process cartridge 42, described later, and is formed so as to incline from a continuing portion 23A continued from the first transport path 32B toward a fixing device 43, described later, rearward and obliquely upward.

The transport rollers 32C are a pair of rollers configured to nip and transport the paper P, and are provided in the first transport path 32B. More specifically, the transport rollers 32C are arranged away from the V-shaped continuing portion 23A on the upstream side in the direction of transport by a distance shorter than the entire length (the length in the direction of transport) of the paper P. Accordingly, when the leading edge of the paper P reaches the continuing portion 23A, a transporting force can be applied to the paper P by the transport rollers 32C. Therefore, the leading edge of the paper P is prevented from being caught by the continuing portion 23A.

The transport rollers 32C are arranged away from the manual paper feed port 21A formed on the front cover 21 by a distance shorter than the entire length of the paper P. Accordingly, the leading edge of the paper P reliably reaches the nip between the pair of transport rollers 32C in the course of insertion of the paper P from the manual paper feed port 21A into the apparatus body 2 by the user, that is, in a state in which part of the paper P is protruded out from the apparatus body 2. Therefore, the transport rollers 32C can be used as a paper feed roller for manual feeding.

The registration rollers 32D are a pair of rollers for aligning the position of the leading edge of the paper P, and are provided in the second transport path 23. More specifically, the registration rollers 32D are arranged at a position slightly away from the continuing portion 23A on the downstream side in the direction of transport.

In the feeder unit 3 configured as described above, the paper P in the paper feed tray 31 is folded back by the paper feed roller 32A, and then is transported to the registration rollers 32D by the transport rollers 32C. Subsequently, the position of the leading edge of the paper P is aligned by the registration rollers 32D, and is transported to the image forming unit 4.

The image forming unit 4 includes a scanner unit 41, the process cartridge 42, and the fixing device 43.

The scanner unit 41 has a known structure including a laser light-emitting unit and a polygon mirror, and is configured to scan the surface of a photoconductive drum 51 of the process cartridge 42 with a laser beam at a high speed.

The process cartridge 42 includes a drum cartridge 5, a developing device 6 as an example of a developing portion, and a toner cartridge 7.

The drum cartridge 5 includes the photoconductive drum 51, a transfer roller 52, and a scorotron charger 53.

The developing device 6 includes a developing roller 61 as an example of a developer carrier, a layer thickness regulating blade 62 as an example of the regulating member, and a supply roller 63 as an example of a supply member, and is detachably attachable to the drum cartridge 5.

The toner cartridge 7 is a container that accommodates toner as an example of developer in the interior thereof, and is detachably attachable to the developing device 6. The detailed structure of the developing device 6 and the toner cartridge 7 will be described later.

The toner cartridge 7 is arranged along the first transport path 32B. Accordingly, wasted space between the toner cartridge 7 and the first transport path 32B is eliminated, and hence the apparatus body 2 is downsized. The toner cartridge 7 is arranged adjacent to the continuing portion 23A, that is, it is arranged so as to approach the second transport path 23 rising from the first transport path 32B. Accordingly, wasted space between the toner cartridge 7 and the second transport path 23 is eliminated, and hence the apparatus body 2 is further downsized.

The developing device 6 is arranged above the toner cartridge 7 at a position adjacent to the second transport path 23. Accordingly, a connecting portion 7A (the surface formed with the supply port) of the toner cartridge 7 with respect to the developing device 6 can be faced upward as shown in FIG. 2, so that a toner leakage from the connecting portion 7A can be restrained. By arranging the developing device 6 adjacent to the second transport path 23, wasted space between the developing device 6 and the second transport path 23 is eliminated, and hence the apparatus body 2 is further downsized.

The above-described drum cartridge 5, the developing device 6, and the toner cartridge 7 are configured to be detachably attachable respectively to the apparatus body 2 from the opening 2A by opening the front cover 21 as shown in FIG. 2.

In the process cartridge 42 configured as described above, as shown in FIG. 1, toner fed from the toner cartridge 7 into the developing device 6 is supplied to the developing roller 61 by the rotating supply roller 63. At this time, the toner becomes positively charged by friction between the supply roller 63 and the developing roller 61. The toner supplied (carried) on the developing roller 61 enters the gap between the layer thickness regulating blade 62 and the developing roller 61 in association with the rotation of the developing roller 61 and is regulated in thickness by the layer thickness regulating blade 62, thereby being carried on the developing roller 61 as a thin layer having a constant thickness.

In contrast, in the drum cartridge 5, after the surface of the photoconductive drum 51 has become positively charged uniformly by the scorotron charger 53, the photoconductive drum 51 is exposed by high-speed scanning using the laser beam from the scanner unit 41. Accordingly, potentials of the exposed portions are lowered, and electrostatic latent images on the basis of image data are formed. Subsequently, the toner carried on the developing roller 61 by the rotation of the developing roller 61 opposes and comes into contact with the photoconductive drum 51, and the toner is supplied to the electrostatic latent images formed on the surface of the photoconductive drum 51.

Accordingly, the toner is carried selectively on the surface of the photoconductive drum 51 and is visualized, and the toner image is formed by reverse development. Subsequently, when the paper P is transported between the photoconductive drum 51 and the transfer roller 52, the toner image carried on the surface of the photoconductive drum 51 is transferred to the paper P.

The fixing device 43 includes a heating roller 43A and a press roller 43B. Then, in the fixing device 43, the toner image transferred to the paper P is thermally fixed while the paper P passes through a nip between the heating roller 43A and the press roller 43B. The paper P thermally fixed by the fixing device 43 is discharged onto the paper discharge tray 22 by a paper discharging roller 44 disposed on the downstream side of the fixing device 43 in the direction of transport.

Provided on the back side of the fixing device 43 and the process cartridge 42 is a third transport path 24 for double-sided printing. The third transport path 24 extends rearward and downward from the downstream side of the fixing device 43 in the direction of transport (specifically, between the fixing device 43 and the paper discharging roller 44), and is configured to join the second transport path 23 on the upstream side of the registration rollers 32D in the direction of transport. Accordingly, in comparison with a mode in which the third transport path 24 merges with the first transport path 32B, the transport path for double-sided printing can be formed without upsizing the apparatus body 2 in the vertical direction.

A plurality of pairs of returning rollers 24A configured to nip and transport the paper P are provided in the third transport path 24. More specifically, three pairs on the upstream side out of the plurality of pairs of returning rollers 24A are arranged at positions away from an obtuse angle bent portion 24B of the third transport path 24 bent at an obtuse angle of 90° or larger on the upstream side in the direction of transport by a distance shorter than the entire length of the paper P. Accordingly, when the leading edge of the paper P reaches the obtuse angle bent portion 24B, a transporting force can be applied to the paper P by the returning rollers 24A. Therefore, the leading edge of the paper P is prevented from being caught by the obtuse angle bent portion 24B.

A pair of the returning rollers 24A positioned at the downstream-most position is arranged in the vicinity of an apex of an acute angle bent portion 24C of the third transport path 24, which is bent at an acute angle smaller than 90°. Accordingly, even when paper jamming is about to occur due to the abutment of the leading edge of the paper P with the acute angle bent portion 24C, the leading edge is nipped by a pair of the returning rollers 24A located at the apex of the acute angle bent portion 24C and hence is forcedly transported, and hence the jamming of the paper P can be restrained.

<Detailed Structure of Developing Device and Toner Cartridge>

Figure 3:
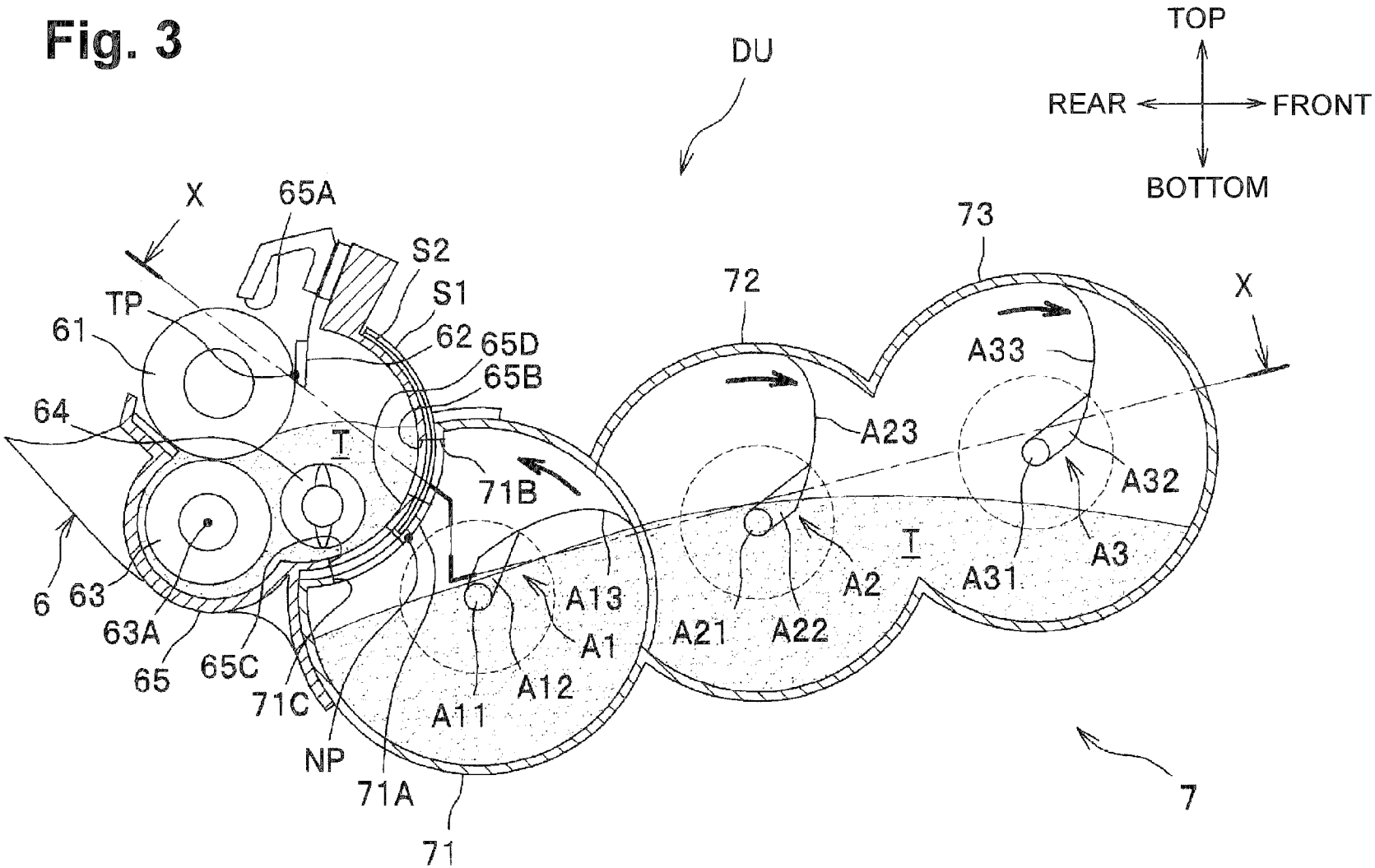
FIG. 3 is a cross-sectional view showing the developing unit.

Referring now to FIG. 3, detailed structures of the developing device 6 and the toner cartridge 7 will be described. As shown in FIG. 3, the developing device 6 and the toner cartridge 7 are combined as a unit, namely, a developing unit DU. FIG. 3 shows the developing unit DU in a state of being mounted on the apparatus body 2.

The developing device 6 includes the developing roller 61, the layer thickness regulating blade 62, and the supply roller 63 described above, an auger 64 as an example of a developer feeding member, and a developing case 65 that accommodates these members 61-65.

An opening 65A is formed on an upper portion of the rear side of the developing case 65 and is opposing the photoconductive drum 51 (shown in FIG. 1). A supply port 65B and two return ports 65C are formed on a lower portion of the front side of the developing case 65. The supply port 65B and the two return ports 65C are corresponding to a supply port 71B and two return ports 71C of the toner cartridge 7, described later (shown in FIG. 4). In this embodiment, a partitioning wall which partitions between the developing device 6 and the toner cartridge 7 includes two partitioning walls, namely, a partitioning wall 65D of the developing device 6 and a partitioning wall 71A of the toner cartridge 7.

The developing roller 61 is arranged so as to be exposed from the opening 65A of the developing case 65, and the supply roller 63 is arranged below the developing roller 61. The layer thickness regulating blade 62 is arranged at a position above the supply ports 65B and 71B so that a contact position TP with respect to the developing roller 61 is positioned above an upper level of toner T in the developing case 65. Accordingly, abnormal substances such as paper powder and the toner T scraped off using the layer thickness regulating blade 62 can be dropped below, and the foreign substances are restrained from staying in the vicinity of the contact position TP. In particular, in this embodiment, the layer thickness regulating blade 62 is arranged so as to oppose the developing roller 61 in the horizontal direction, and is in sliding contact with a substantially abeam the developing roller 61. Accordingly, the abnormal substances scraped off using the layer thickness regulating blade 62 are prevented from dropping again on the developing roller 61, but are reliably scraped off from the developing roller 61.

Figure 5:
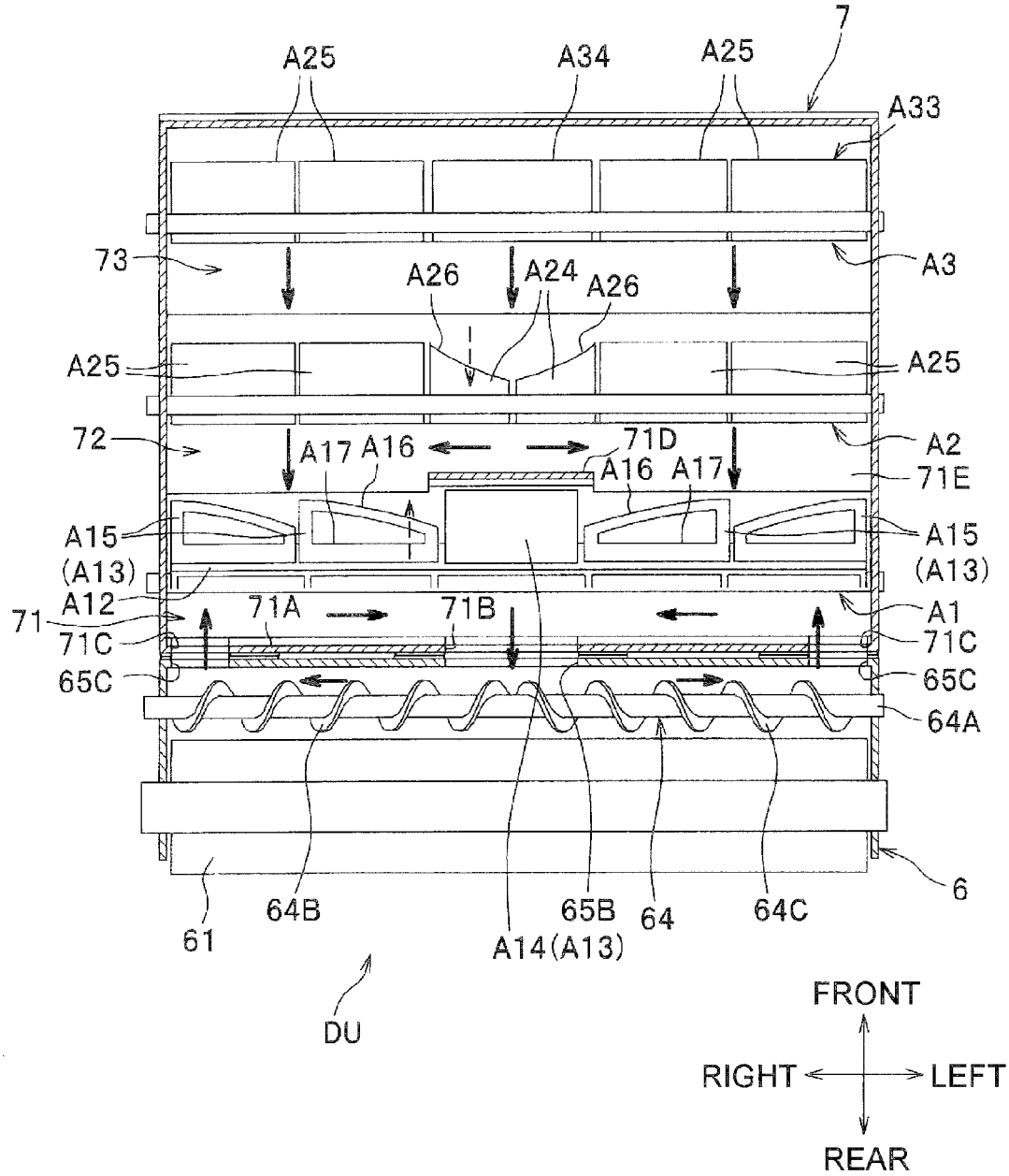
FIG. 5 is a cross-sectional view of the developing unit taken along the line X-X in FIG. 3.

The auger 64 is arranged below the layer thickness regulating blade 62, more specifically, vertically below (right below) the contact position TP, and is configured to transport the toner T in the direction of the axis of the developing roller 61 (parallel to the axis of the supply roller 63), more specifically, laterally from the laterally center to both sides as shown in FIG. 5. Accordingly, the deteriorated toner T scraped off by the layer thickness regulating blade 62 is dispersed favorably by the auger 64 in the lateral direction. Therefore, the upper level of the toner T right below the contact position TP can be flattened and the top portion of the accumulated toner T can be restrained from staying in the vicinity of the contact position TP.

More specifically, the auger 64 includes an axis of rotation 64A, and a first spiral blade 64B and a second spiral blade 64C provided so as to wound around the axis of rotation 64A in a spiral manner.

Then, the first spiral blade 64B and the second spiral blade 64C are arranged on the right side and the left side, respectively, of the center portion (in the vicinity of the supply port 65B) in the direction of the axis of rotation 64A so that the direction of spiral is different from each other. Accordingly, the toner T is transported to the right side by the first spiral blade 64B, and the toner T is transported to the left side by the second spiral blade 64C.

As shown in FIG. 3, the toner cartridge 7 includes a first developer storage portion 71, a second developer storage portion 72, and a third developer storage portion 73 configured to accommodate the toner T.

The first developer storage portion 71 is arranged adjacent to the developing device 6 below (obliquely forward and downward) the developing device 6 when the toner cartridge 7 is mounted on the developing device 6 (more specifically, when the developing unit DU is mounted on the apparatus body 2). The first developer storage portion 71 is formed into a substantially hollow column shape, and the partitioning wall 71A of the first developer storage portion 71 is formed to be depressed toward the first developer storage portion 71.

More specifically, the partitioning wall 71A is formed into an arcuate shape in cross section having a portion extending in the substantially horizontal direction and a portion extending in the substantially vertical direction. The partitioning wall 71A is formed with the supply port 71B for supplying the toner T from the toner cartridge 7 to the developing device 6 and the two return ports 71C (shown in FIG. 4) for returning the toner T from the developing device 6 to the toner cartridge 7.

Figure 4:
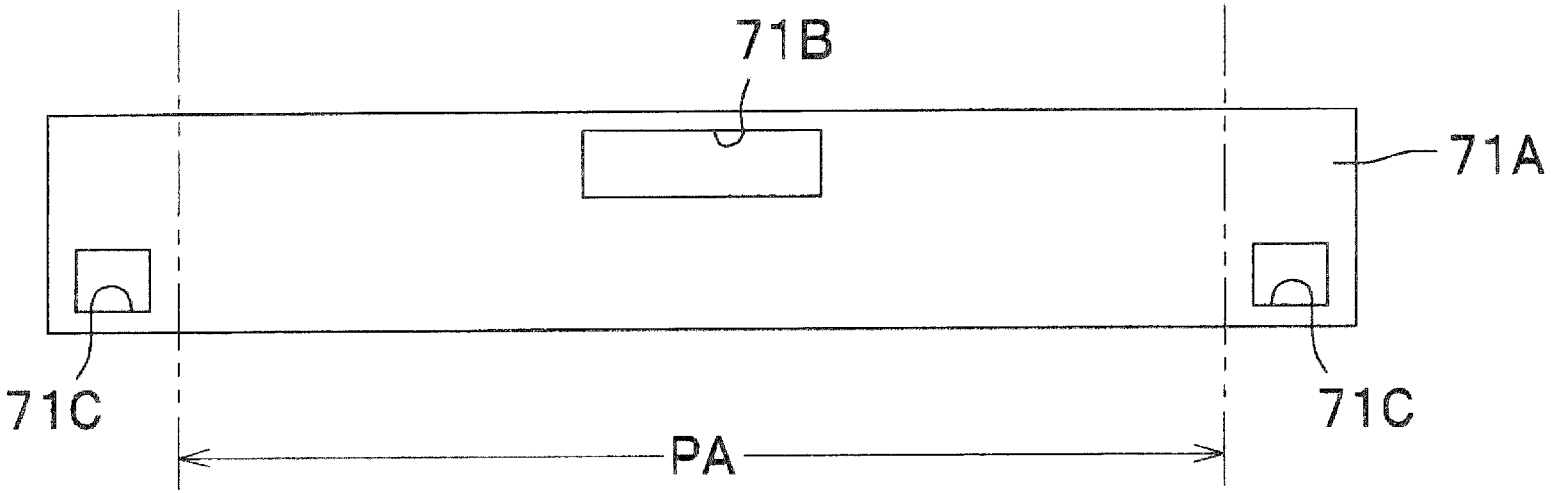
FIG. 4 is an explanatory drawing showing layouts of a supply port and return ports of the toner cartridge.

As shown in FIG. 4, the supply port 71B is solely formed at a laterally center portion of an upper half of the partitioning wall 71A. The return ports 71C are formed at each of laterally both side portions of a lower half of the partitioning wall 71A, more specifically, at each area laterally out of a printing area PA. In other words, the return ports 71C are formed at positions deviated laterally (the axial direction of the supply roller 63) and downward from the supply port 71B.

Then, by the positioning of the return ports 71C deviated in the axial direction of the supply roller 63 in this manner, the toner T supplied from the supply port 71B into the developing device 6 can be prevented from returning immediately into the toner cartridge 7 from the return ports 71C. Granted that the return ports and the supply port are arranged at the same position in the axial direction, it is difficult to make a flow of the toner T in the developing device 6. However, by the positioning of the supply port 71B and the return ports 71C deviated in the axial direction as in this embodiment, the flow directed from the supply port 71B to the return ports 71C as shown in FIG. 5 can be formed.

As shown in FIG. 3, the supply port 71B opens sideward by being formed on the partitioning wall 71A in a portion extending in the substantially vertical direction and opposing the auger 64 in the horizontal direction. The term "sideward" here means the horizontal direction including directions slightly inclined from the horizontal direction.

In this manner, with the supply port 71B faced sideward, the toner T can be transported into the developing device 6 efficiently from the supply port 71B using a first agitator A1 as an example of a first agitating member, described later. In other words, when the supply port 71B is faced upward, the toner T may return back into the toner cartridge 7 from the supply port 71B immediately after having pushed the toner T upward into the developing device 6 from the supply port 71B using the first agitator A1. However, with the supply port 71B faced sideward, such reversion is restrained.

An upper end of the supply port 71B is arranged downward of the contact position TP where the layer thickness regulating blade 62 is contacting the developing roller 61. Accordingly, the upper level of the toner T in the developing device 6 can be placed reliably below the contact position TP, so that the pressure applied from the toner T to a sliding contact portion between the developing roller 61 and the layer thickness regulating blade 62 or respective seal members (not shown) which come into sliding contact with the developing roller 61 can be reduced. Consequently, the excessive toner T or foreign substances such as paper powder are restrained from leaking out from the sliding contact portion.

In addition, the upper end of the supply port 71B is arranged above a center 63A of the supply roller 63. Accordingly, since the toner T can be supplied to a portion of the peripheral surface of the supply roller 63 above the center 63A, the toner T held on the peripheral surface of the supply roller 63 can hardly drop downward. Therefore, the toner T can be favorably supplied to the developing roller 61.

The first developer storage portion 71 of the toner cartridge 7 is arranged downward of the developing device 6, and hence the supply port 71B is arranged above the upper level of the toner T in the first developer storage portion 71. Accordingly, in order to feed the toner T from the interior of the first developer storage portion 71 to the supply port 71B, the toner T is needed to be lifted upward using the first agitator A1, described later. Therefore, the toner T drops moderately when being lifted upward and transported, and hence the amount of transport can be maintained substantially constantly. By keeping the amount of transport of the toner T from the first developer storage portion 71 into the developing device 6 substantially constant in this manner, the position of the upper level of the toner T in the developing device 6 can be kept substantially constant. Therefore, the accumulation of the toner T in the vicinity of the contact position TP can reliably be restrained.

The upper level of the toner T in the first developer storage portion 71 must simply be positioned below the supply port 71B in a state in which the toner cartridge 7 is unused (the state having the maximum amount of toner), and in the state in which the developing unit DU is mounted on the apparatus body 2, and the amount of toner is determined as needed so as to achieve such positioning.

By the arrangement of the supply port 71B in this manner, the upper level of the toner in the first developer storage portion 71 is lower than the upper level of the toner in the developing device 6. Accordingly, the upper level of the toner in the developing device 6 does not move in conjunction with the movement of the upper level of the toner in the toner cartridge 7, and is kept at a substantially constant position.

The upper level of the toner T in the first developer storage portion 71 is lower on the rear side (the side of the developing device 6) and higher on the front side because the direction of rotation of the first agitator A1, described later, is counterclockwise in the drawing. Accordingly, the toner T of the higher portion on the front side can be favorably transported to the supply port 71B facing sideward. Simultaneously, a rather wide space is formed between the upper level of the toner T of the lower portion on the back side and the return ports 71C, described later. Consequently, the toner T is easily returned from the return ports 71C into the first developer storage portion 71.

The supply port 71B, the supply roller 63, and the auger 64 are arranged in the horizontal direction (at positions overlapped when viewed in the fore-and-aft direction). Accordingly, a sufficient amount of supply of the toner T from the supply port 71B to the auger 64 can be secured, and a sufficient amount of toner T moving from the auger 64 toward the supply roller 63 in the process of feeding the toner T in the direction of axis of rotation by the auger 64 can be secured as well. Therefore, the toner T can be supplied stably to the supply roller 63 while keeping the position of the upper level of the toner T in the developing device 6 at a predetermined level.

The supply port 71B is arranged on the opposite side of the supply roller 63 with the intermediary of the auger 64. Therefore, new toner T supplied from the supply port 71B into the developing device 6 is dispersed in the direction of axis by the auger 64, so that it can be mixed with the deteriorated toner T.

Furthermore, the supply port 71B is formed on the upstream side of a near point NP of the partitioning wall 71A, which is closest to a rotating shaft All of the first agitator A1, described later, in the direction of rotation of the first agitator A1. Accordingly, since the rotating first agitator A1 moves toward the supply port 71B, the toner T kept by the first agitator A1 can be supplied to the supply port 71B so as to be squeezed therein, so that a sufficient amount of the toner T can be supplied from the supply port 71B to the developing device 6.

The return ports 71C are formed on the downstream side of the near point NP of the partitioning wall 71A described above in the direction of rotation. The first agitator A1 is moved away from the return ports 71C by arranging the return ports 71C in this manner, so that the toner T can easily be returned from the return ports 71C into the first developer storage portion 71.

The return ports 71C are formed on the partitioning wall 71A on a portion extending in the substantially horizontal direction and hence open downward. The term "downward" here means the vertical direction including directions slightly inclined from the vertical direction.

In this manner, with the return ports 71C faced downward, the toner T can be returned from the developing device 6 efficiently to the toner cartridge 7, and hence improvement of the circularity is achieved. Since the efficiency to return the toner T can be improved by forming the return ports 71C so as to face downward, the opening surface area of the return ports 71C can be reduced. Therefore, upsizing of the developing unit DU is prevented or reduced even when the return ports 71C are provided out of the printing area PA (shown in FIG. 4).

The term "printing area PA" here means the area inside the maximum width (the length in the direction orthogonal to the direction of transport) of the toner image to be transferred to the paper P. Then, by the arrangement of the return ports 71C out of the printing area PA in this manner, the accumulation of the toner T on the left and right both end portions (out of the printing area PA) in the developing device 6 is restrained. Here, the toner T may be a short in the developing device 6 opposing the return ports 71C. However, as it is out of the printing area PA, no printing failure occurs.

The return ports 71C are arranged below the layer thickness regulating blade 62 so as to be overlapped with the layer thickness regulating blade 62 when viewed from above. Therefore, the deteriorated toner T scraped off by the layer thickness regulating blade 62 is apt to be discharged from the return ports 71C into the toner cartridge 7.

Figure 6A:
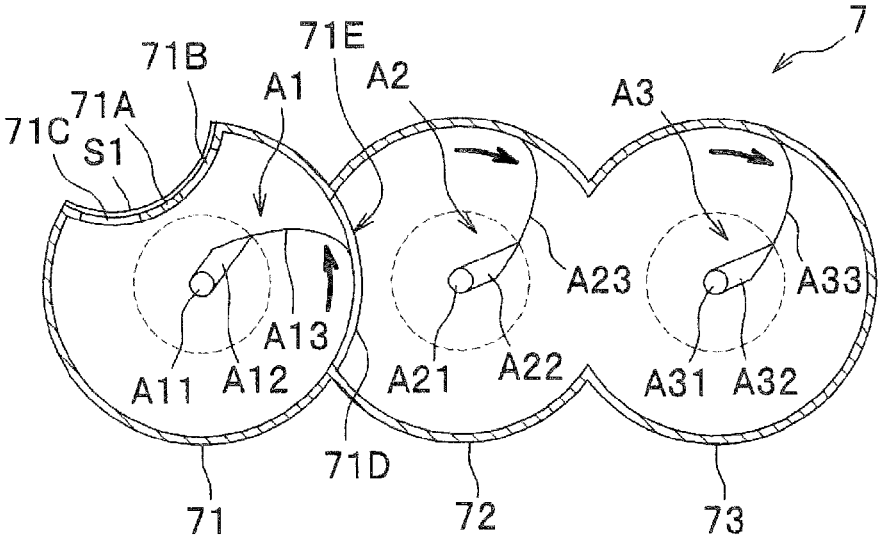
FIG. 6A is a cross-sectional view of the toner cartridge.

As shown in FIG. 6A, a first shutter S1 which opens and closes the supply port 71B and the return ports 71C by moving along the circumferential direction of the partitioning wall 71A is provided on the outside of the partitioning wall 71A. The first shutter S1 is formed of a thin metallic panel or the like formed into an arcuate shape along the partitioning wall 71A.

As shown in FIG. 3, the partitioning wall 65D on the side of the developing device 6 is also provided with a second shutter S2 in an arcuate shape along the partitioning wall 65D. Accordingly, the first shutter S1 and the second shutter S2 are configured to engage with each other and integrally rotate.

A problem of leakage of the toner T from between the first shutter S1 and the partitioning wall 71A, and from between the second shutter S2 and the partitioning wall 65D may be predicted. However, in this embodiment, the opening surface area of the return ports 71C can be reduced by forming the return ports 71C so as to face downward, and hence the toner leakage can be reduced. There is a case of providing sponges in a shape surrounding the return ports 71C and the like between the first shutter S1 and the partitioning wall 71A, and between the second shutter S2 and the partitioning wall 65D to prevent or reduce the toner leakage. In this case as well, the sponges corresponding to the return ports 71C can be downsized corresponding to the downsizing of the return ports 71C, whereby the sliding resistance at the time of opening and closing the shutter may be reduced.

The first agitator A1 configured to rotate so as to come into sliding contact with the partitioning wall 71A from the top to the bottom (rotate counterclockwise in the drawing) is provided in the first developer storage portion 71. The first agitator A1 includes the rotating shaft A11 rotatably supported by the left and right walls of the toner cartridge 7 (first developer storage portion 71), a supporting portion A12 extending radially outward from the rotating shaft A11, and an agitating blade A13 supported by the supporting portion A12.

The agitating blade A13 includes a first film A14 arranged at the laterally center portion and second films A15 arranged two each on laterally both sides of the first film A14 as shown in FIG. 5. In other words, the agitating blade A13 has a width which can accommodate both the supply port 71B and the respective return ports 71C (the width which is able to come into sliding contact with the both) in general.

The first film A14 is a resiliently deformable rectangular film, and is formed to have the substantially same width as the width (the width in the lateral direction) of the supply port 71B. The first film A14 is in sliding contact with opposed wall 71D (shown in FIG. 6A) being in an arcuate shape in cross-section formed between the first developer storage portion 71 and the second developer storage portion 72 in a bent state.

The opposed wall 71D is provided so as to extend upright and close the center portion of the wide opening which communicates the first developer storage portion 71 with the second developer storage portion 72. More specifically, the opposed wall 71D is arranged so as to oppose the supply port 71B (at a position corresponding thereto), and is formed to have a width equal to or larger than the width of the first film A14. Accordingly, the toner T transported by the first film A14 is transported upward between the first film A14 and the opposed wall 71D, and then is transported favorably toward the supply port 71B.

The respective second films A15 are resiliently deformable films, and are each configured in such a manner that a sliding contact portion A16 coming into sliding contact with an inner surface of the first developer storage portion 71 is inclined rearward in the direction of rotation (the direction indicated by an arrow shown in broken line in the drawing) as it goes toward the first film A14. More specifically, the each second film A15 is configured in such a manner that a laterally inner portion comes into sliding contact with an inner surface of the first developer storage portion 71 later than the laterally outer portion of the sliding contact portion A16 by its shape and the direction to be supported by the supporting portion A12 which are set appropriately.

With such configuration that the sliding contact portions A16 of the respective second films A15 come into sliding contact at the laterally inner portions thereof with the inner surface of the first developer storage portion 71 later than the laterally outer portions thereof, the toner T is transported from the return ports 71C on the laterally outer sides toward the supply port 71B at the center. The each second film A15 is formed with a hole A17 at the center portion thereof. With this hole A17, the toner T returning back from the return ports 71C into the first developer storage portion 71 is prevented from being excessively returned back from the first developer storage portion 71 to the second developer storage portion 72.

In other words, by setting the sizes of the holes A17 as needed, a suitable amount of the toner T in the first developer storage portion 71 can be returned back to the second developer storage portion 72. Accordingly, part of the deteriorated toner T returned from the developing device 6 into the toner cartridge 7 is fed into the second developer storage portion 72, whereby the deteriorated toner T can be favorably dispersed between the first developer storage portion 71 and the second developer storage portion 72.

As shown in FIG. 3, in a state in which the developing unit DU is mounted on the apparatus body 2, the second developer storage portion 72 is adjacently arranged obliquely forward and upward with respect to the first developer storage portion 71. Accordingly, the transport of the toner T from the second developer storage portion 72 to the first developer storage portion 71 can be favorably performed using attraction of gravity.

The second developer storage portion 72 is formed into a substantially hollow column shape, and the rear portion thereof other than the above-described opposed wall 71D corresponds to a communication port 71E (shown in FIGS. 5 and 6A) which communicates with the first developer storage portion 71, and the substantially entirely of the front portion thereof communicates with the third developer storage portion 73. Provided in the second developer storage portion 72 is a second agitator A2 as an example of a second agitating member configured to transport the toner T accumulated on the bottom in the second developer storage portion 72 to the first developer storage portion 71 via the communication port 71E by rotating in the opposite direction from the direction of rotation of the first agitator A1 (clockwise in the drawing). In other words, the first agitator A1 and the second agitator A2 rotate in different directions so as to rotate upward from below with respect to the communication port 71E formed between the first developer storage portion 71 and the second developer storage portion 72. The second agitator A2 includes a rotating shaft A21 and a supporting portion A22, which are substantially the same in structure as those in the first agitator A1 described above, and an agitating blade A23 having a different structure from that of the first agitator A1.

The agitating blade A23 includes a pair of resiliently deformable third films A24 arranged at the laterally center portion and resiliently deformable rectangular fourth films A25 arranged two each on laterally both sides of the third films A24 as shown in FIG. 5.

The third films A24 are provided side by side in the lateral direction within the width of the above-described opposed wall 71D, so that sliding contact portions A26 which come into sliding contact with the inner surface of the second developer storage portion 72 are inclined forward in the direction of rotation (the direction indicated by an arrow shown in a broken line) as they go to the adjacent third films A24. More specifically, the each third film A24 is configured in such a manner that the laterally outer portion comes into sliding contact with the inner surface of the second developer storage portion 72 later than the laterally inner portion of the sliding contact portion A26 by its shape and the direction to be supported by the supporting portion A22 which are set appropriately.

With such configuration that the sliding contact portions A26 of the respective third films A24 come into sliding contact at the laterally outer portions thereof with the inner surface of the second developer storage portion 72 later than the laterally inner portions thereof, the toner T is transported toward the laterally outsides. In other words, the respective third films A24 function as blades which transport the toner T from the laterally center to the laterally outsides. Therefore, the toner T transported by the respective third films A24 is put together toward the fourth films A25 so as to keep out of the opposed wall 71D arranged rearward of the respective third films A24, and then fed to the first developer storage portion 71 by the fourth films A25.

As shown in FIG. 3, when the developing unit DU is mounted on the apparatus body 2, the third developer storage portion 73 is adjacently arranged obliquely forward and upward with respect to the second developer storage portion 72. Accordingly, the transport of the toner T from the third developer storage portion 73 to the second developer storage portion 72 can be favorably performed using attraction of gravity.

The third developer storage portion 73 is formed into a substantially hollow column shape, and the rear portion thereof communicates with the second developer storage portion 72 substantially entirely. Provided in the third developer storage portion 73 is a third agitator A3 configured to transport the toner T accumulated on the bottom in the third developer storage portion 73 to the second developer storage portion 72 by rotating in the opposite direction from the direction of rotation of the first agitator A1 (clockwise in the drawing). The third agitator A3 includes a rotating shaft A31 and a supporting portion A32, which are substantially the same in structure as those in the second agitator A2 described above, and an agitating blade A33 having a slightly different structure from that of the second agitator A2.

The agitating blade A33 includes a resiliently deformable rectangular fifth film A34 at the laterally center portion and two each of the fourth films A25 as those in the second agitator A2 are provided on both left and right sides of the fifth film A34 as shown in FIG. 5. Accordingly, the entire toner T in the third developer storage portion 73 can be transported to the second developer storage portion 72 at once.

Figure 6B:
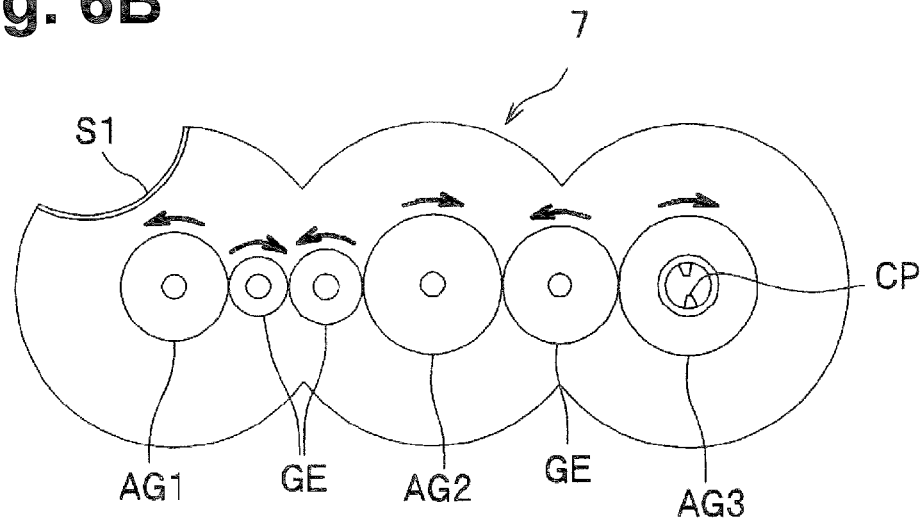
FIG. 6B is a side view of the toner cartridge.

Provided at one end portion of each of the first agitator A1, as shown in FIG. 6B the second agitator A2, and the third agitator A3 are first agitator gear AG1, a second agitator gear AG2, and a third agitator gear AG3 coaxially (concentrically) integrally in one unit. Two gears GE and GE are provided between the first agitator gear AG1 and the second agitator gear AG2 and a gear GE is provided between the second agitator gear AG2 and the third agitator gear AG3.

Accordingly, when a drive force is transmitted from a drive source, not shown, to a coupling portion CP formed at a center axis portion of the third agitator gear AG3, the third agitator gear AG3 and the second agitator gear AG2 rotate in the same direction, and the first agitator gear AG1 rotates in the opposite direction. The first agitator gears AG1, . . . are covered with a gear case, not shown, detachably attached to side walls of the toner cartridge 7.

In this configuration, in this embodiment, the following effects are achieved.

The foreign substances can be restrained from being accumulated in the vicinity of the contact position TP by placing the contact position TP above the upper level of the toner T in the developing device 6. Therefore, the foreign substances can be restrained from passing through the gap between the layer thickness regulating blade 62 and the developing roller 61.

The toner T in the developing device 6 is always kept loose by being constantly moved by the auger 64, so that problems caused by insufficient flow of the toner T hardly occur.

The supply roller 63, the auger 64, and the supply port 71B are arranged in the horizontal direction, a sufficient amount of supply of the toner T from the supply port 71B to the auger 64 can be secured, and a sufficient amount of toner T moving from the auger 64 toward the supply roller 63 in the process of feeding the toner T in the direction of axis of rotation by the auger 64 can be secured as well. Therefore, the toner T can be supplied stably to the supply roller 63 while keeping the toner level in the developing device 6 at a predetermined level.

Since the upper end of the supply port 71B is arranged below the contact position TP, the upper level of the toner in the developing device 6 can reliably be set below the contact position TP.

With the arrangement of the auger 64 vertically below the contact position TP, the toner T scraped off by the layer thickness regulating blade 62 can be flattened by the auger 64. Therefore, the accumulation of the toner T in the vicinity of the contact position TP can be restrained more effectively.

The toner T can be supplied to an upper half of a peripheral surface of the supply roller 63 by arranging the upper end of the supply port 71B above the center 63A of the supply roller 63. Therefore, the toner T can be supplied favorably from the supply roller 63 to the developing roller 61.

Since the supply port 71B is arranged above the upper level of the toner T in the first developer storage portion 71, the toner T is lifted upward in order to feed the toner T from the interior of the first developer storage portion 71 to the supply port 71B. Therefore, the toner T drops moderately when being lifted upward and transported, and hence the amount of transport can be maintained substantially constantly. By keeping the amount of transport of the toner T from the first developer storage portion 71 into the developing device 6 substantially constant in this manner, the toner level in the developing device 6 can be kept substantially constant. Therefore, the accumulation of the foreign substances in the vicinity of the contact position TP can be restrained more effectively.

The supply port 71B is formed on the partitioning wall 71A on the upstream side of the near point NP, which is closest to the rotating shaft A11 of the first agitator A1 in the direction of rotation of the first agitator A1, and the return ports 71C are formed on the downstream side thereof in the direction of rotation. Therefore, the toner T can be pushed into the supply port 71B by the first agitator A1, and the first agitator A1 can be moved away from the return ports 71C. Therefore, the supply of the toner T from the supply port 71B into the developing device 6 is favorably achieved, and the toner T can be returned easily from the return ports 71C to the first developer storage portion 71. Therefore, the sufficient circulation of the toner T is achieved.

The first agitator A1 and the second agitator A2 are rotated upward from below with respect to the communication port 71E formed between the first developer storage portion 71 and the second developer storage portion 72. Therefore, the toner T accumulated in the first developer storage portion 71 is returned to the second developer storage portion 72 by the first agitator A1, and the toner T accumulated in the second developer storage portion 72 is pushed out into the first developer storage portion 71 by the second agitator A2. Therefore, the circulation of the toner T between the second developer storage portion 72 and the first developer storage portion 71 is achieved, so that the accumulation of the toner T in the toner cartridge 7 can be prevented.

The present invention is not limited to the embodiment described above, and may be used in various modes as exemplified below.

In the embodiment described above, the developing portion and the developer storage portion are made up of two components (the developing device 6 and the toner cartridge 7). However, the present invention is not limited thereto, and the developing portion and the developer storage portion may be configured integrally as one unit. In other words, the developing unit may be made up of one component instead of two components. When employing the developing unit made up of one component, only one partitioning wall is required for partitioning the developing portion and the developer storage portion, and the shutter and the like is no longer necessary.

In the embodiment described above, the supply ports 65B and 71B and the return ports 65C and 71C are provided on the partitioning walls 65D and 71A of the developing device 6 and the toner cartridge 7 respectively. However, the present invention is not limited thereto, and a large opening formed so as to communicate with both the supply port and the return ports on one partitioning wall may be provided on the other partitioning wall. In other words, for example, a configuration in which the portion of the partitioning wall 71A of the toner cartridge 7 in the embodiment described above is configured entirely as an opening, and the opening of the toner cartridge 7 is covered with the partitioning wall 65D of the developing device 6 is also applicable. In other words, part (partitioning wall) of the toner cartridge may be configured with the partitioning wall of the developing device.

Figure 7:
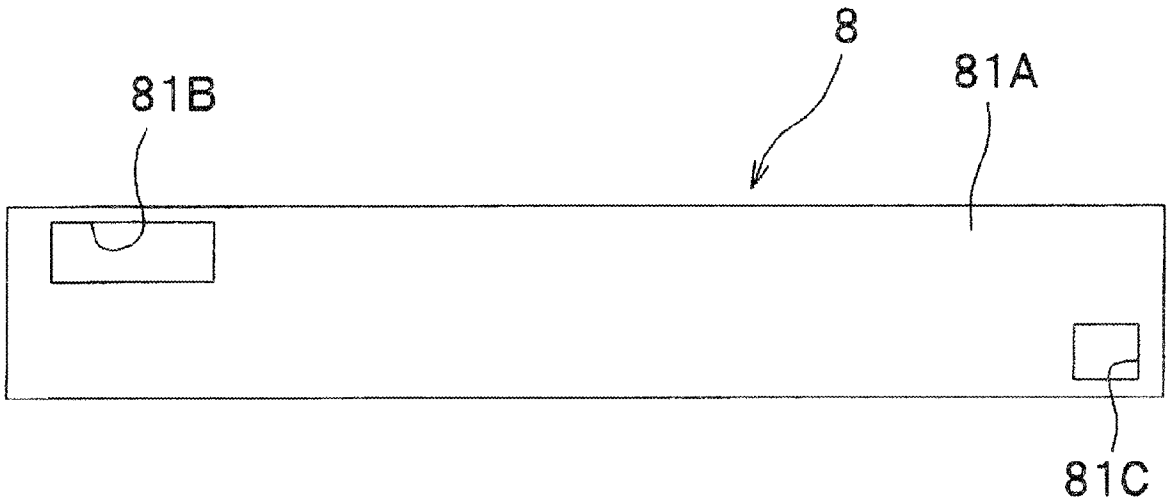
FIG. 7 is an explanatory drawing showing a modification of the layouts of the supply port and the return ports.

The positions and the numbers of the supply port and the return ports are not limited to those in the embodiment described above and may be set appropriately. For example, as shown in FIG. 7, a configuration in which one wide supply port 81B is formed on a partitioning wall 81A of a toner cartridge 8 on one end side in the lateral direction, and one return port 81C is formed on the other end side at apposition below the supply port 81B is also applicable.

Figure 8:
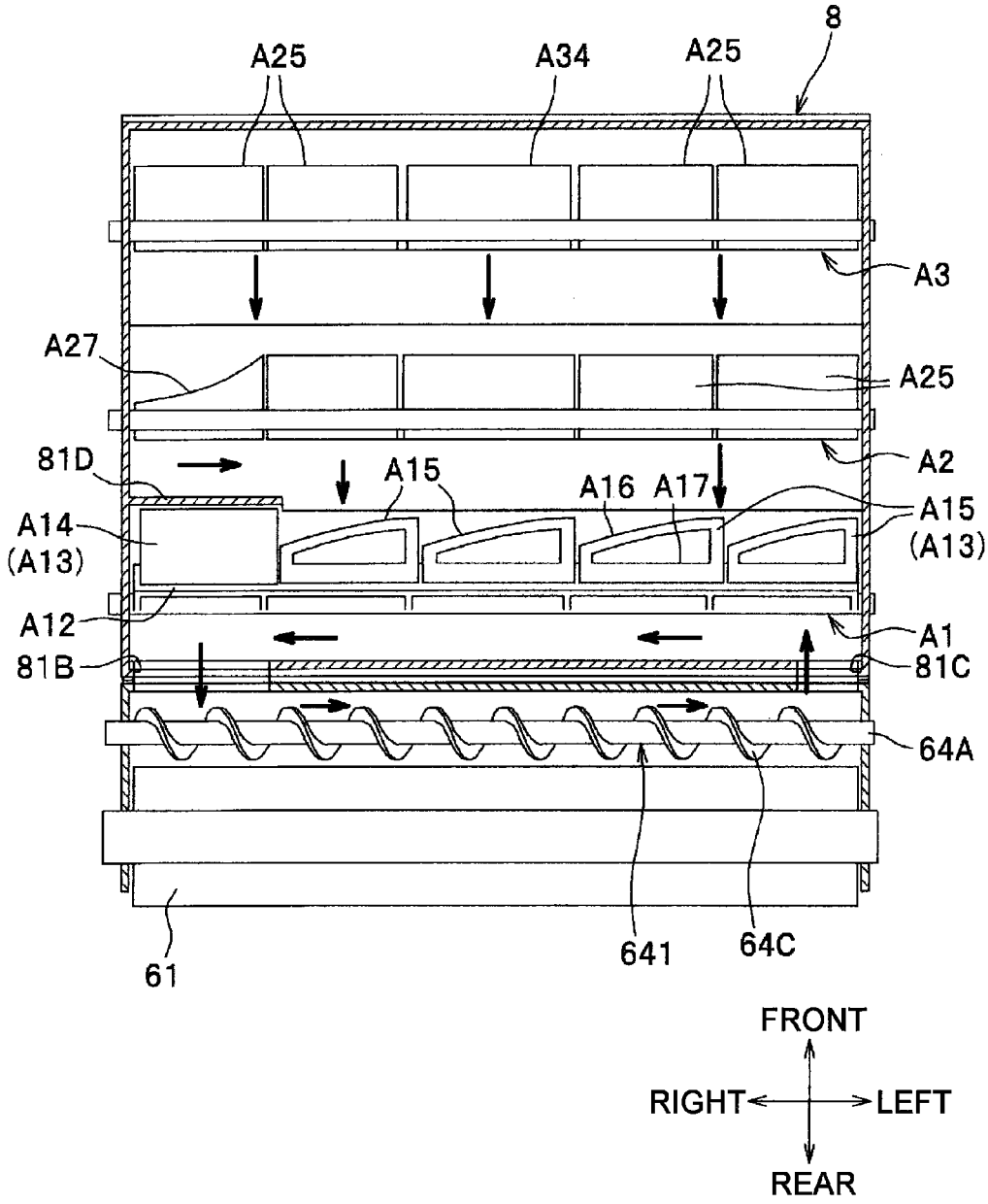
FIG. 8 is a cross-sectional view showing positions of a partitioning wall and the like corresponding to the mode shown in FIG. 7.

In this case, as shown in FIG. 8, an auger configured to send the toner T from the one end to the other end in the lateral direction, that is, an auger 641 having only one type of blade (second spiral blade 64C) may be employed as the developer feeding member. In this case, what should be done is to change the positions of an opposed wall 81D, the first film A14, and the second films A15 respectively so as to correspond to the position of the supply port 81B, and to change the shape of a third film A27 arranged on the front side of the opposed wall 81D into a shape for transporting the toner T only to one side.

In the embodiment described above, the agitator having the rotating shaft A11, the supporting portion A12, and the agitating blade A13 as the agitating members is employed. However, the present invention is not limited thereto and, for example, an agitator that does not have the supporting portion A12 may be employed. Also, as the regulating member, a blade formed only, for example, of a metal plate without rubber may be employed instead of the layer thickness regulating blade 62 provided with the rubber at the distal end of the metal plate as in the embodiment.

In the embodiment described above, the present invention is applied to the laser printer 1. However, the present invention is not limited thereto, and may be applied to other image forming apparatuses such as copying machines or multifunctional peripherals.

What is claimed is:

1. A developing unit comprising:

a developing portion including:

a rotatable developer carrier configured to carry developer;

a rotatable supply member arranged below the developer carrier and configured to supply the developer to the developer carrier;

a regulating member configured to come into sliding contact with the rotatable developer carrier to regulate the thickness of the developer on the rotatable developer carrier; and a developer feeding member arranged below the regulating member and configured to feed the developer in a direction of a rotation axis of the rotatable supply member;

a first developer storage portion configured to accommodate the developer and arranged adjacent to the developing portion; and a partitioning wall configured to partition between the developing portion and the first developer storage portion, the partitioning wall having a supply port for supplying the developer from the first developer storage portion to the developing portion, and further having a return port for returning the developer from the developing portion to the first developer storage portion, wherein the regulating member is contacting with the rotatable developer carrier at a contact position located above an upper level of the developer in the developing portion, wherein an upper end of the supply port is arranged below a lowest end of the contact position, wherein the first developer storage portion includes a first agitating member configured to transport the developer to the supply port by rotating in sliding contact with a wall which forms the first developer storage portion, the partitioning wall has a shape depressed toward the interior of the first developer storage portion, the supply port is formed on the partitioning wall on an upstream side of a close point, which is closest to a rotation axis of the first agitating member, in a rotation direction of the first agitating member, and the return port is formed on the partitioning wall on a downstream side of the close point in the rotation direction of the first agitating member.

2. The developing unit according to claim 1, wherein the rotatable supply member, the developer feeding member, and the supply port are arranged in the horizontal direction.

3. The developing unit according to claim 1, wherein the developer feeding member is arranged vertically below the contact position.

4. The developing unit according to claim 1, wherein the upper end of the supply port is arranged above a center of the rotatable supply member.

5. The developing unit according to claim 1, wherein the supply port is arranged above the upper level of the developer in the first developer storage portion.

6. The developing unit according to claim 1, wherein the rotatable developer carrier includes a developer roller.

7. The developing unit according to claim 1, wherein the partitioning wall includes a first wall included in the developing portion and a second wall included in the first developer storage portion.

8. A developing unit comprising:

a developing portion including:

a rotatable developer carrier configured to carry developer;

a rotatable supply member arranged below the developer carrier and configured to supply the developer to the developer carrier;

a regulating member configured to come into sliding contact with the rotatable developer carrier to regulate the thickness of the developer on the rotatable developer carrier; and a developer feeding member arranged below the regulating member and configured to feed the developer in a direction of a rotation axis of the rotatable supply member;

a first developer storage portion configured to accommodate the developer and arranged adjacent to the developing portion;

a partitioning wall configured to partition between the developing portion and the first developer storage portion, the partitioning wall having a supply port for supplying the developer from the first developer storage portion to the developing portion, and further having a return port for returning the developer from the developing portion to the first developer storage portion, a second developer storage portion arranged adjacent to the first developer storage portion and configured to accommodate the developer, the second developer storage portion having a communication port communicating with the first developer storage portion; and a second agitating member configured to send the developer in the second developer storage portion to the first developer storage portion via the communication port, wherein the regulating member is contacting with the rotatable developer carrier at a contact position located above an upper level of the developer in the developing portion, wherein an upper end of the supply port is arranged below a lowest end of the contact position, and wherein both of the first agitating member and the second agitating member rotate upward from a position below the communication port, and rotate in different directions about respective rotation axes.

* * * * *